United States Patent [19]

MacDuff

[11] 3,963,899

[45] June 15, 1976

[54] VOTING MACHINE

[76] Inventor: John MacDuff, 232 Astor Court, Villa Park, Ill. 60181

[22] Filed: May 9, 1975

[21] Appl. No.: 576,145

[52] U.S. Cl. ..... 235/50 B
[51] Int. Cl.[2] ..... G07C 13/00
[58] Field of Search ..... 235/50 A, 50 B, 51, 235/56

[56] References Cited

UNITED STATES PATENTS

| | | | |
|---|---|---|---|
| 3,233,826 | 2/1966 | Wilken | 235/51 |
| 3,536,257 | 10/1970 | Laws | 235/50 B |

*Primary Examiner*—Edith Simmons Jackmon
*Attorney, Agent, or Firm*—Hill, Gross, Simpson, Van Santen, Steadman, Chiara & Simpson

[57] ABSTRACT

A voting machine employs a scroll-type multi-layer ballot structure including removable strips carried by the upper layer and a pressure responsive means in the lower layer to reproduce markings made on the removable strips. Each removable strip carries a voter number so that an audit of each ballot can be made by the voter without revealing his identity. The multi-layer scroll-type structure is carried behind a panel having a slot therein extending in the direction of the removable strips and a door covering the slot which is prevented from opening to provide access to the strips in response to operation of the mechanism which senses whether or not a strip has been removed.

11 Claims, 8 Drawing Figures

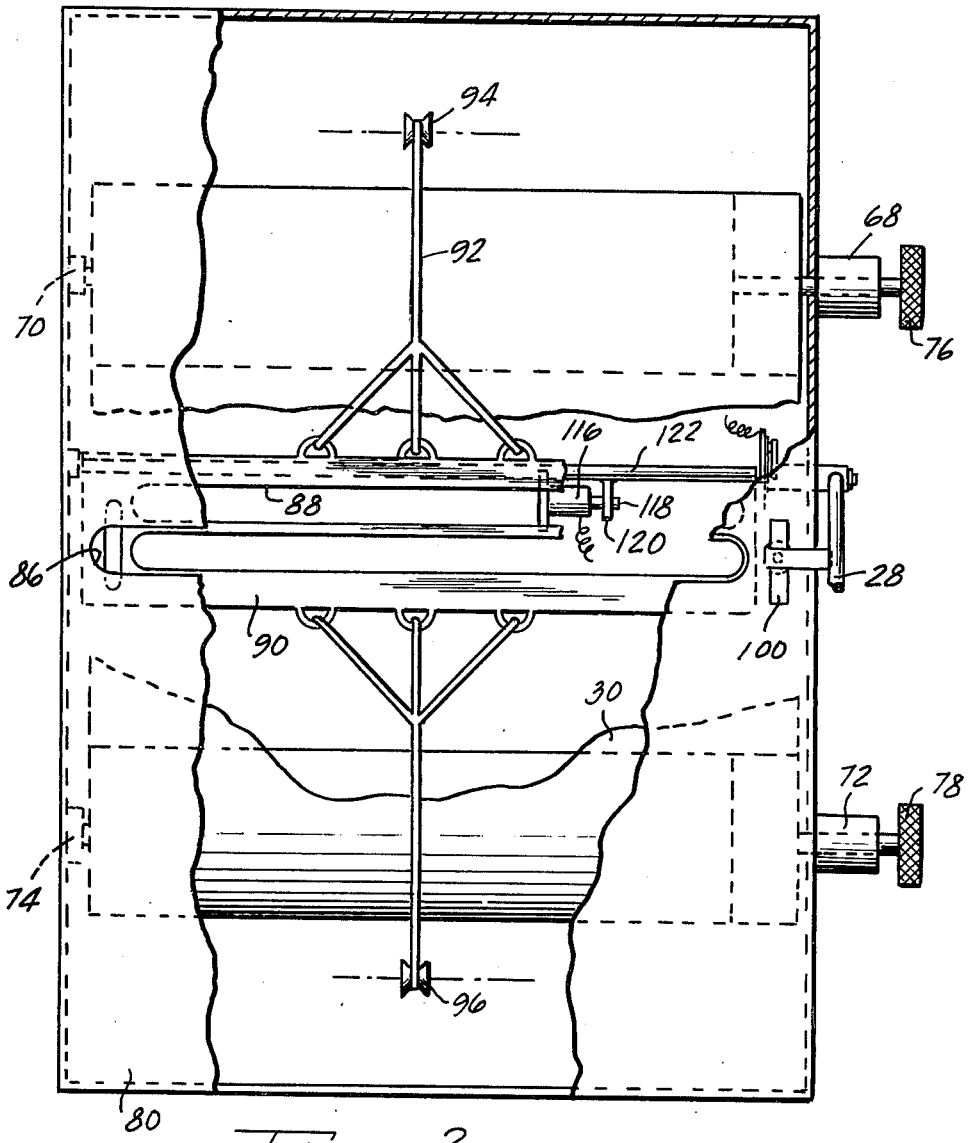
Fig. 2
Fig. 5
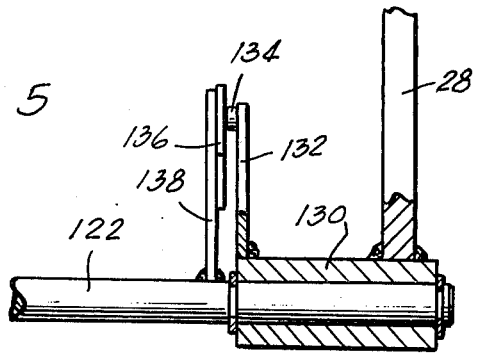

VOTING MACHINE

BACKGROUND OF THE INVENTION

1. Field of the Invention

This invention relates to voting machines, and is more particularly concerned with manually operated voting machines which include scrolls which record votes so that the same may be audited in addition to being tallied.

2. Description of the Prior Art

Voting machines presently being used in national, state and local elections mechanically and/or electrically record each vote cast on a ballot and provide a tally for each issue presented to the voters. The records are then canvassed (retallied) for certification of the vote.

Such systems, and such machines which operate in such systems, provide only a tally of the vote, rather than an actual audit of the vote so that the individual voter cannot determine if his vote has been correctly recorded and counted in that there is no means for identifying his ballot from any other ballot. This, of course, is also true in elections where paper ballots are employed. In many instances this leads to allegations of voting fraud which, in respect of the ballots, cannot be readily proved or disproved.

SUMMARY OF THE INVENTION

It is the primary object of the invention therefore, to provide a voting system by which the individual voter may audit his own ballot and still remain anonymous in performing such an audit.

Another object of the invention is to provide an auditible ballot structure which maintains the individual voter identity in secrecy.

Another object of the invention is to provide an auditible ballot structure by which an individual voter can maintain a record of his vote for purpose of challenging a vote tally.

Another object of this invention is to provide a voting machine which incorporates an auditible ballot structure and prevents access to previously voted ballots.

BRIEF DESCRIPTION OF THE DRAWINGS

The above and other objects, features and advantages of the invention, together with its organization, construction and operation will be best understood from the following detailed description taken in conjunction with the accompanying drawings, on which:

FIG. 2 is generally a plan view of the voting portion of the booth of FIG. 1 as seen by a voter;

FIG. 5 is a fragmentary view of a portion of a apparatus of FIGS. 2 and 3 showing a manually operated control lever and lost motion mechanism in greater detail;

DESCRIPTION OF THE PREFERRED EMBODIMENTS

Figure 1:
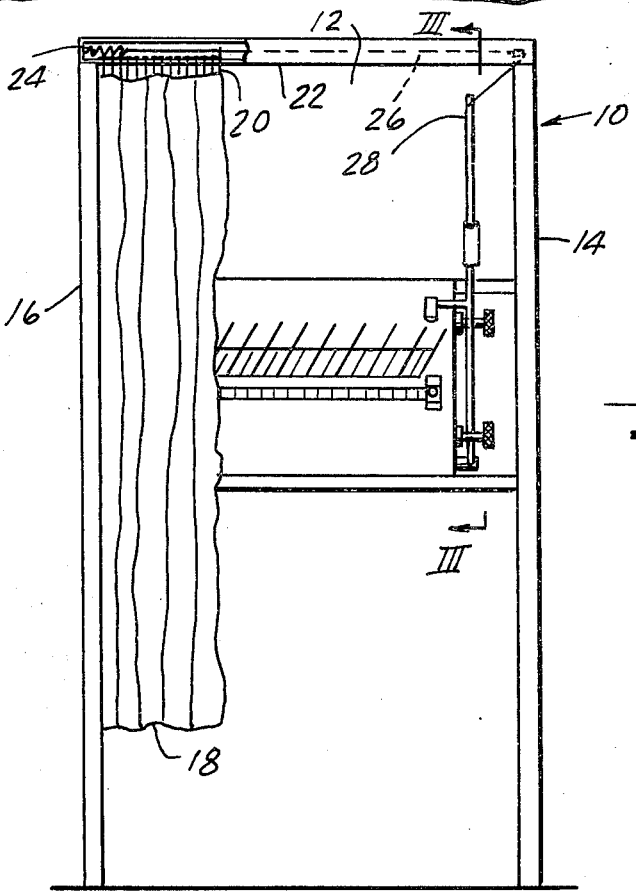
FIG. 1 is a front elevational view of a voting machine constructed in accordance with the principles of the invention.
Figure 3:
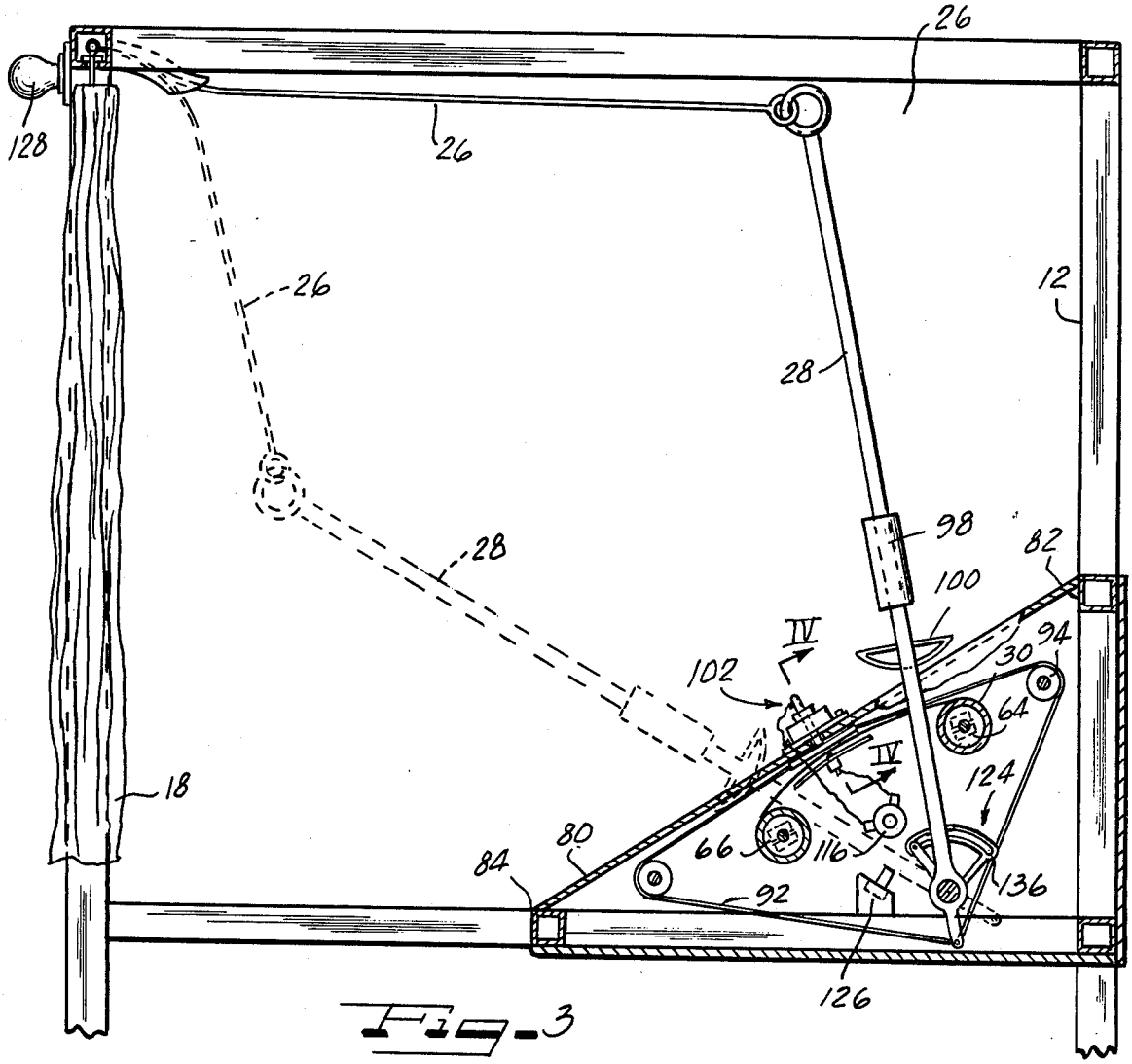
FIG. 3 is a sectional view taken substantially along the lines III—III of FIG. 1.

Referring to FIGS. 1 and 3, a voting machine is illustrated as comprising a voting booth 10 having a rear wall 12 and a pair of sidewalls 14 and 16. A curtain 18 is slidably carried on a rod 22 by means of a plurality of hangers 20 for closing the booth 10. A spring 24 is connected between the left-hand side of the booth and the right-hand side of the curtain 18 (as viewed in FIG. 1) to bias the curtain toward an open position. A cable 26 is connected to the right-hand portion of the curtain 18 and to a manually operated lever 28 for moving the curtain to the closed position when the lever 28 is moved clockwise as viewed in FIG. 3.

Figure 6:
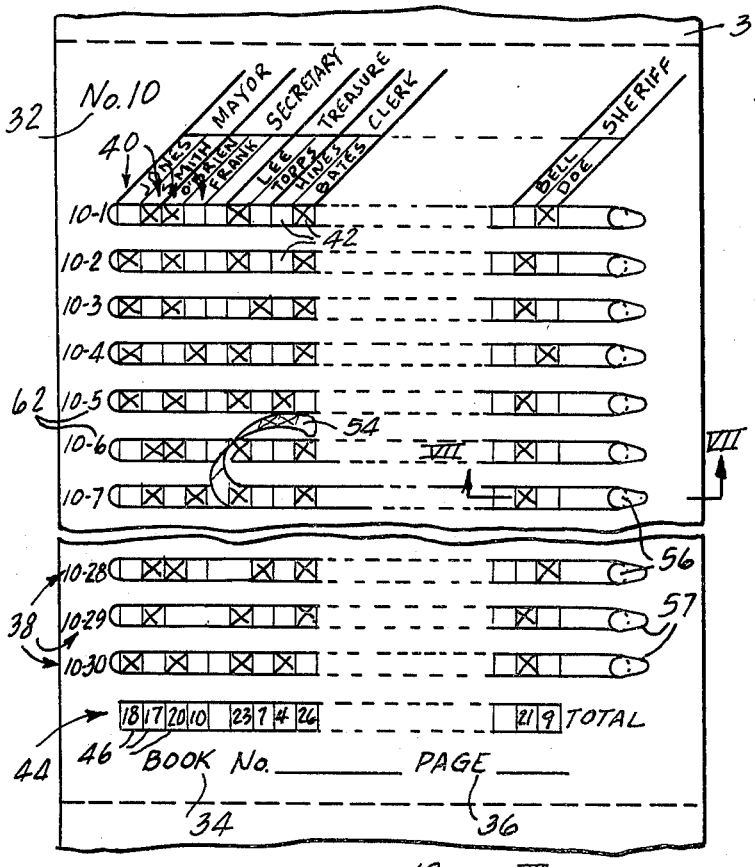
FIG. 6 is a fragmentary plan view of a scroll-type multi-layer ballot structure constructed in accordance with the invention.

Referring for a moment to FIG. 6, an auditible multi-layer ballot in the form of a scroll 30 is illustrated as comprising a plurality of ballot sheets 30*a*, 30*b*, 30*c*, etc, which may be separated into individual sheets as indicated by the broken lines therebetween. Each of the sheets carries an indicia 32 which identifies the particular sheet, an indicia therefore identifies a book in which the sheet is to be subsequently bound, and an indicia 36 identifying the page number of the book.

Each of the sheets also carries a plurality of indicia 38 each of which includes a voter identification number 62 by which, as will be understood from the description below, a voter may remain anonymous and audit his vote. Each sheet further carries a plurality of indicia 40, arranged generally perpendicular to the indicia 38 such that the intersections of the indicia 38 and the indicia 40 identify ballot voting areas relating to voter and issue. In this sense a voting issue is taken in its broadest sense to include candidate, referendum question, resolution question of the like for which a voter may cast his vote. Each of the ballot areas is identified as 42 in FIG. 6.

Each sheet also carries an indicia 44 having a number of areas 46 for recording the tally of the votes cast on that particular sheet.

Figure 7:
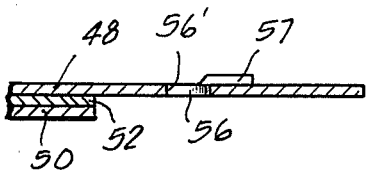
FIG. 7 is a sectional view of a portion of the structure of FIG. 6 taken generally along the line VII—VII of FIG. 6.

Referring to FIGS. 6 and 7, the scroll of ballot 30 is illustrated as comprising a multi-layer structure which includes a first layer means 48, and a second layer means which may, in turn, comprise one or more layers 50, 52. The upper layer 48 is to receive pencil marks made by a voter and the lower layer of layers are to reproduce and record the identical markings. If a pressure sensitive reproduction layer is employed below the layer 48, only a single layer is necessary for the layers 50 and 52. In the alternative, the layer 50 may be employed to record the reproduction of the marks on the layer 48 by means of a carbor paper layer 52 disposed therebetween which is employed to reproduce such marks.

The upper layer 48 carries, at each ballot indicia 38 a removable strip, in the form of a peel-off strip or a tear-out strip 54. The indicia 38 is actually carried on this removable strip, including the sheet and voter identification number. It should be noted that the layer which records the vote and stays with the machine (50 and/or 52) carries identical indicia as the upper layer including the removable strips so that each vote may be later identified by referring to the proper sheet and voting location so that each voter may audit his own vote.

At the right-hand side of the ballot 30, the upper layer 48 includes an aperture 56' in which is disposed a nonconductive filler 56, which may be in the form of paper, plastic or the like. The filler 56 is connected to the associated removable strip 54 and is removable therewith to provide a passageway through the aperture 56' from the upper side of the ballot to the lower side thereof. The reason for this will become clear from the discussion below relating to the latch mechanism.

Figure 8:
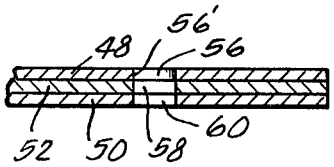
FIG. 8 is a view similar to FIG. 7 showing an alternate multi-layer ballot structure which may be employed in practicing the present invention.

Referring to FIG. 8, the multi-layer ballot structure is seen to comprise somewhat identical elements to the structure illustrated in FIG. 7, with the exception that the layers are coextensive and include aligned apertures 58 and 60 below the aperture 56'. With this structure, also, removal of the strip 54 removes the filler 56 to provide a through opening between the upper and lower surfaces of the ballot.

Referring now to FIGS. 2 and 3, the scroll 30 is carried on a pair of rollers 64 and 66. The roller 64 is journaled at 68 and 70, while the roller 66 is journaled at 72 and 74. The rollers 64 and 66 are provided with respective knurled knobs 76 and 78 so that a voter may operate the scroll in either direction.

As best illustrated in FIG. 3, the scroll is mounted behind a sheet or panel 80 which is connected to the booth at 82 and 84 so as to provide the voter with a slanted desk-type surface. It should be noted that the issues presented to the voter are also carried with an indicia corresponding to the indicia 40 on the surface of the panel 80, preferably immediately above an elongate horizontally extending slot 86 through which the voter is to have access to the scroll 30.

Access to the scroll 30 by way of the slot 86 is provided via a corresponding slot 88 or a door 90 which is mounted to move parallel to the panel 80 under the control of the lever 28. The door 90 is carried by a cable 92 which is entrained about a pair of rollers 94 and 96 and connected to the lever 28 so that movement of the lever clockwise, as viewed in FIG. 3, causes the door 90 to move in a direction by which the slots 86 and 88 may become aligned.

Figure 4:
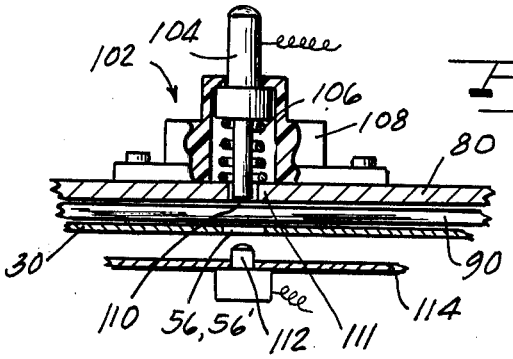
FIG. 4 is a sectional view of a door control mechanism taken generally along the lines IV—IV of FIG. 3.

The voter may grasp the lever 28 at a handle 98 and move the same toward the full-line position illustrated in FIG. 3 from the broken line position. In doing so a bow-shaped actuator 100 carried by the lever 28 engages a latch control mechanism 102 which is illustrated in greater detail in FIG. 4. The latch control mechanism 102 comprises a plunger 104 which is surrounded at its lower end by a spring 106 and held in a holder 108 so that the plunger is spring loaded and biased upwardly. The lower end 110 of the plunger 104 extends through an opening 111 in the panel 80 which is aligned with the path of travel of the apertures 56'. If an aperture 56' has had the filler 56 removed (that ballot has been voted) the lower end 110 of the plunger 104 passes through the aperture 56' to engage a contact 112. The plunger 104 and the contact 112 are connected in circuit with a solenoid device 116 which has an extensible member 118 (FIG. 2) disposed in an interference relationship with a projection 120 carried on a shaft 122 which is rotated by the lever 28. Completion of the electrical circuit to the solenoid 116 extends the member 118 which, in turn, prevents further rotation of the lever 28 and alignment of the slots 86 and 88. If however, the filler 56 is disposed in the aperture 56', the plunger 104 is prevented from contacting the contact 112 so that the extensible member 118 remains out of interference with the projection 120 so that the lever may be moved to a position at which the slots 86 and 88 are aligned.

As the lever 28 is rotated clockwise, as viewed in FIG. 3, it operates a mechanism 124 which in turn operates a switch 126 to turn off a lamp 128 mounted outside of the booth 10 to indicate that the voter has begun the voting process. Inasmuch as the scroll may be positioned at a ballot which has already been voted, it is preferred that the lamp 128 not indicate that voting is in process until such time as the bow 100 has passed the plunger 104. Therefore, a lost-motion mechanism is employed. The lost-motion mechanism comprises a sleeve 130 which mounts the lever 28 on the shaft 122 (FIG. 5) and which mounts an arm 132 which carries a pin 134 which extends through an arcuate slot of a member 136 carried by an arm 138 on the shaft 122. With this structure, the lever may be rotated about the shaft 122 through an ankle which corresponds to the relative disposition of the plunger 104 to sense for the presence or absence of a filler 56 before the light is extinguished. By the same token, after balloting has been completed by the voter, and he removes his strip 54, the bow should pass the plunger 104 before the lever moves the mechanism back into contact with the switch 126.

In voting, a voter steps into the booth 10 through the open curtain 18 and moves the voting scrolls by means of the knurled knobs to an unused ballot. An unused ballot may be detected by the voter by viewing the non-marking parts of the ballot in the area of the voter identification portion of the indicia 38 through an opening provided between the door 90 and the left-hand edge of the slot 86. If the voter still aligns a used ballot with the slot 86, the filler sensing mechanism will prevent that ballot from being remarked by preventing opening of the door 90.

It should be pointed out that the use of the door 90 is not necessary, but that it prevents remarking or obliteration of a used ballot whether the same is done intentionally or accidentally.

After selecting a ballot, the voter pushes the lever 28 to extinguish the lamp 128, close the curtain and lock the knobs 76 and 78. The knobs 76 and 78 may be locked by the provision of an electromagnetic latch connected in circuit with the switch 126.

If the election is a general election, the voter reads the indicia on the panel 80 and marks his ballot accordingly with X's. If the election is a primary election, and if the voter must vote a single party, the indicia on the panel may be a hinges flipover type card or a multiple of cards, each identifying a party at separate vertical alignment areas. In order to prevent confusion between marking X's for each party, each party may have a unique mark assigned thereto such as X, O, Y, etc. In this manner, a voter may also split his ballot in a primary election where such type voting is permitted. The voter is therefore given the dignity of an equal, yet private vote.

When the voter has finished marking his ballot he pulls the tab 57 attached to the filler 56 of his removable strip 54 and peels-off or tears-off his ballot, his vote having been reproduced and recorded on the layers therebelow. His removable strip, as mentioned above carries his vote indentification by sheet number and voter number on that sheet so that he may later compare his vote with that of the ballot sheet when the same is posted. This provides the voter with an auditible control over his own vote.

The voter than pulls the lever to open the curtain, light the lamp, close the door and unlock the knobs. At this time, the voting machine is not operable by another person until the ballot has been moved to an unused space.

When the election is over, or the ballot is used up, the election clerk removes the scroll from the machine, tallies the vote and enters the tally for each sheet at the indicia 44, 46. The empty scroll cylinders may then be refilled and replaced in the machine for continued voting or for storage until the next election.

The ballots may be counted by hand or by machine; however, in either case the ballots should be cut off at predetermined intervals, say every twenty-five strips, to be posted, either bound in books or unbound, as individual sheets.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A voting machine comprising: an enclosure;

a panel mounted in said enclosure including a front surface and a rear surface and having a slot therein;

a movable door mounted adjacent said panel and movable to cover and uncover said slot;

a record mounted adjacent said rear surface for movement relative said slot said record bearing indicia in rows thereacross in first and second perpendicular directions, said first row direction being the same as the direction of said slot so that such first direction rows may be revealed on-at-a-time through said slot;

said record including a multi-layer structure comprising a first layer bearing said indicia and to be marked by a voter, a second layer responsive to making pressure on said first layer to produce corresponding makings, a tear-out section along each row to the first direction to receive the voter markings, and an aperture through said multi-layer structure having a filling therein, wherein said filling is removed upon removal of each of said tear-out sections, the filled apertures aligned in the second direction;

a lever connected to said door and operable in alternate directions to move said door to respectively uncover and cover said slot;

switch means mounted adjacent said multi-layer structure in the area of said apertures including switch contacts and a member movable toward and away from said structure, said member operated by said lever to move said member against said multi-layer structure and through an aperture to operate said switch contacts when a tear-out section has been removed; and a latch mechanism connected to and operated by said switch contacts to prevent opening of said door when a row with a tear-out section removed is aligned with said slot.

2. The voting machine of claim 1, comprising:

a rotatably mounted shaft carrying said lever;

a latch projection extending radially from said shaft;

an electromagnetic device included in said latch mechanism including an extensible member movable into and out of an interference relationship with said projection.

3. The voting machine of claim 1, wherein said switch means comprises:

one of said switch contacts carried by said member;

switch mounting means mounting said movable member on one side of said panel;

a first switch contact carried on said member;

a second switch contact mounted on the opposite side of said panel with said record therebetween; and spring means urging said movable member away from said second contact.

4. The voting machine according to claim 1, wherein said multilayer structure comprises:

said first layer for receiving voter applied markings;

said second layer in the form of a carbon-paper-type layer;

a third layer below said second layer to receive markings from said second layer.

5. The voting machine of claim 1, wherein said multilayer structure comprises:

said first layer for receiving voter applied markings; and a pressure sensitive layer below said first layer as said second layer and reponsive to marking pressures to generate and exhibit corresponding markings in response to said voter markings.

6. The voting machine of claim 1, wherein said record includes:

a plurality of record sheets defined by sheet indicia borne on said record, said sheet indicia providing an indication as to where the record is to be separated into separate sheets, each of said sheets bearing indicia of sheet number and totals entry positions for entering the totals of marks in said second row direction.

7. The voting machine of claim 1, wherein said door includes a plate mounted adjacent said panel for movement parallel to said panel and includes a slot therein for alignment with said slot in said panel when said door is in the uncovering position.

8. The voting machine of claim 1, comprising:

a curtain mounted on said enclosure for entry and exit of said enclosure, said curtain movable between open and closed positions; and means connecting said curtain to said lever for moving said curtain in response to movement of said lever.

9. The voting machine of claim 1, comprising:

a lamp mounted outside of said enclosure; and a switch operated by said lever to connect and disconnect said lamp and an electrical supply.

10. The voting machine of claim 1, comprising:

at least one roller rotatably mounted in said enclosure and carrying said record thereon.

11. The voting machine of claim 1, comprising:

a pair of parallel spaced rollers rotatably mounted in said enclosure and carrying said record as a scroll.

* * * * *